US006625418B2

(12) United States Patent
Kabai et al.

(10) Patent No.: US 6,625,418 B2
(45) Date of Patent: Sep. 23, 2003

(54) IMAGE FORMING APPARATUS, METHOD FOR FORMING IMAGE, AND FIXING DEVICE

(75) Inventors: Takahito Kabai, Yokohama (JP); Yoshiaki Okano, Hino (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/996,573

(22) Filed: Nov. 30, 2001

(65) Prior Publication Data

US 2003/0103787 A1 Jun. 5, 2003

(51) Int. Cl.[7] ..... G03G 15/20

(52) U.S. Cl. ..... 399/329; 219/216; 430/109.1; 430/124

(58) Field of Search ..... 399/328, 329; 219/216, 388; 430/124, 109.1

(56) References Cited

U.S. PATENT DOCUMENTS 5,840,456 A * 11/1998 Tomita et al. ..... 430/109.1
6,134,400 A * 10/2000 Higashi ..... 219/216 X
6,282,398 B1 * 8/2001 Higashi ..... 399/329
6,351,619 B1 * 2/2002 Yamada ..... 399/329 X
6,363,229 B1 * 3/2002 Shiraishi et al. ..... 219/216 X
6,449,457 B2 * 9/2002 Samei et al. ..... 399/328
2002/0018676 A1 * 2/2002 Hirai et al. ..... 399/329

FOREIGN PATENT DOCUMENTS

| | | |
|---|---|---|
| JP | 3-67269 | 3/1991 |
| JP | 8-82951 | 3/1996 |
| JP | 10-282822 | 10/1998 |
| JP | 2001-83821 | * 3/2001 |

* cited by examiner

*Primary Examiner*—Sophia S. Chen
(74) *Attorney, Agent, or Firm*—Foley & Lardner

(57) ABSTRACT

A fixing device includes a fixing belt movably supported by a rotatable heating member and a rotatable support member equipped with a surface elastic layer having a hardness not higher than 40°. The fixing device also includes a pressurizing mechanism arranged to face the support member with the fixing belt interposed therebetween and equipped with a pressurizing member movable in synchronism with the fixing belt.

16 Claims, 4 Drawing Sheets

IMAGE FORMING APPARATUS, METHOD FOR FORMING IMAGE, AND FIXING DEVICE

BACKGROUND OF THE INVENTION

The present invention relates to an image forming apparatus such as an electrostatic recording apparatus or an electrophotographic apparatus and to a fixing device used in the image forming apparatus.

In an image requiring high quality such as a full-color image, the roughness of the image was a problem to be solved in the past. The roughness is derived from the nonuniformity of the dots forming the image. Particularly, the nonuniform melting of the developing agent in the fixing step under a thermal pressure and the collapse of the dots caused by the pressure were considered to be the main causes of the nonuniformity of the dots. Such being the situation, it has been known in the art to suppress the nonuniformity of the dots in the fixing step by using a fixing roller made of rubber having a low hardness. However, the fixing roller made of rubber having a low hardness has a short life, and so increases the printing cost.

On the other hand, a method is employed using a roller covered with a fluorine-containing resin such as perfluoroalkoxy resin (PFA) as a means for prolonging the life of the fixing roller. However, the roller of this type has an excessively high hardness so as to bring about the nonuniformity of the dots in the fixing step so as to further promote the roughness. Also, where the roller is covered with a fluorine-containing resin having a low hardness, the covering surface layer is wrinkled in the manufacturing process of the roller so as to cause a nonuniform fixing of the printed image.

BRIEF SUMMARY OF THE INVENTION

An object of the present invention, which has been achieved in view of the situation described above, is to obtain easily and at a low cost an image of a high quality free from roughness.

According to a first aspect of the present invention, there is provided an image forming apparatus, comprising:

an image carrier;

a developing device to form a developing agent image on the image carrier by using a developing agent;

a transfer device to transfer the developing agent image onto a recording surface of a recording material; and a fixing device to fix the transferred developing agent image onto the recording surface, the fixing device including a fixing belt movably supported by a rotatable heating member and a rotatable support member equipped with a surface elastic layer having a hardness not higher than 40°, and a pressurizing mechanism arranged to face the support member with the fixing belt interposed therebetween and equipped with a pressurizing member movable in synchronism with the fixing belt.

According to a second aspect of the present invention, there is provided an image forming apparatus, comprising:

a first image carrier;

a first developing device to form a first developing agent image on the first image carrier by using a first developing agent;

a second image carrier;

a second developing device to form a second developing agent image on the second image carrier;

a transfer device to transfer the second developing agent image onto a recording surface of a recording material after transfer of the first developing agent image onto the recording surface of the recording material; and a fixing device to fix the transferred developing agent image onto the recording surface, the fixing device including a fixing belt movably supported by a rotatable heating member and a rotatable support member equipped with a surface elastic layer having a hardness not higher than 40°, and a pressurizing mechanism arranged to face the support member with the fixing belt interposed therebetween and equipped with a pressurizing member movable in synchronism with the fixing belt.

According to a third aspect of the present invention, there is provided a method for forming an image, comprising:

developing a latent image to form a developing agent image on an image carrier by using a developing agent;

transferring the developing agent image onto a recording surface of a recording material to form a transferred image; and fixing the transferred image to the recording surface by introducing a recording material having the transferred image into a fixing device including a rotatable heating member, a fixing belt movably supported by a rotatable support member equipped with a surface elastic layer having a hardness not higher than 40°, and a pressurizing mechanism arranged to face the support member with the fixing belt interposed therebetween and equipped with a pressurizing member movable in synchronism with the fixing belt to permit the heating member to heat the fixing belt and to press the pressurizing mechanism against the support member via the fixing belt and the recording material.

According to a fourth aspect of the present invention, there is provided a method for forming an image, comprising:

developing a latent image to form a first developing agent image on a first image carrier by using a first developing agent;

forming a second developing agent image on a second image carrier by using a second developing agent;

transferring the second developing agent image onto a recording surface of a recording material after transfer of the first developing agent image onto the recording surface of the recording material; and fixing the transferred image to the recording surface by introducing a recording material having the transferred image into a fixing device including a fixing belt movably supported by a rotatable heating member and a rotatable support member equipped with a surface elastic layer having a hardness not higher than 40°, and a pressurizing mechanism arranged to face the support member with the fixing belt interposed therebetween and equipped with a pressurizing member movable in synchronism with the fixing belt to permit the heating member to heat the fixing belt and to press the pressurizing mechanism against the support member via the fixing belt and the recording material.

Further, according to a fifth aspect of the present invention, there is provided a fixing device, comprising:

a fixing belt movably supported by a rotatable heating member and a rotatable support member equipped with a surface elastic layer having a hardness not higher than 40°; and a pressurizing mechanism arranged to face the support member with the fixing belt interposed therebetween and equipped with a pressurizing member movable in synchronism with the fixing belt.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the present invention.

DETAILED DESCRIPTION OF THE INVENTION

Figure 1:
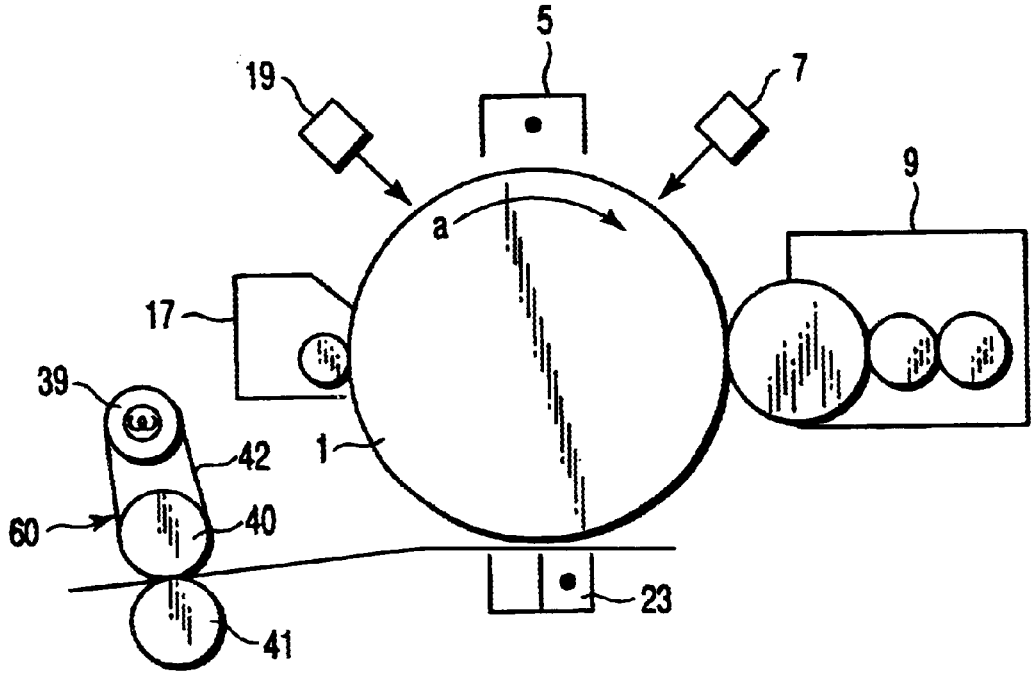
FIG. 1 schematically shows as an example the construction of an image forming apparatus according to the present invention.

The fixing device of the present invention comprises a heating member, a support member, a fixing belt and a pressurizing mechanism including a pressurizing member. The heating member is rotatable. The support member includes a surface elastic layer having a hardness not higher than 40° and is rotatable. The fixing belt is movably supported by the heating member and the support member. Further, the pressurizing mechanism includes a pressurizing member arranged to face the support member with the fixing belt interposed therebetween and is arranged movable in synchronism with the fixing belt.

The heating member is in the form of, for example, a roller and is equipped with a heater. It is possible to connect a temperature adjusting mechanism such as a temperature detector or a temperature control device to the heating member.

The support member is also in the form of, for example, a roller, and a surface elastic layer having a hardness not higher than 40° is formed on the surface of the support member. It is desirable for the hardness of the surface elastic layer to fall within a range of between 10° and 40°, more desirably between 20° and 35°.

The fixing belt is supported so as to be movable in a predetermined direction by the rotary driving of the heating member and the support member.

The fixing belt includes a base material and a covering layer formed on the base material. The base material is formed of a metallic thin film such as a nickel electroformed film or a seamless belt of a heat resistant resin thin film such as a polyimide film. On the other hand, the covering layer is formed of a material selected from the group consisting of a silicone rubber, a heat resistant rubber such as a fluororubber, and a fluorine-containing resin. It is also possible to use a laminate structure comprising a silicon rubber and a PFA tube for forming the covering layer.

It is desirable for the nickel electroformed based material to have a thickness falling within a range of between 20 $\mu$m and 70 $\mu$m, more desirably between 30 $\mu$m and 50 $\mu$m. If the thickness of the nickel electro-formed base material is smaller than 20 $\mu$m, the workability in the manufacturing process tends to be rendered poorly On the other hand, if the thickness exceeds 70 $\mu$m, the durability tends to be rendered poorly Also, it is desirable for the thickness of the entire fixing belt to fall within a range of between 100 $\mu$m and 600 $\mu$m, more desirably between 150 $\mu$m and 400 $\mu$m. If the thickness of the entire fixing belt is less than 100 $\mu$m, the belt itself tends to lose its elasticity. On the other hand, if the thickness of the entire fixing belt exceeds 600 $\mu$m, the heat capacity tends to be excessively increased so as to render the rise of the temperature poorly.

The image forming apparatus of the present invention uses the fixing device described above and comprises an image carrier, a developing device for forming a developing agent image on the image carrier by using a developing agent, a transfer device for transferring the developing agent image onto a recording surface of a recording material, and a fixing device for fixing the transferred developing agent image onto the recording surface of the recording material. The fixing device used in the present invention includes a fixing belt movably supported by a rotatable heating member and a rotatable support member equipped with a surface elastic layer having a hardness not higher than 40°, and a pressurizing mechanism arranged to face the support member with the fixing belt interposed therebetween and equipped with a pressurizing member movable in synchronism with the fixing belt.

Also, the image forming apparatus of the present invention includes a monochromatic image forming apparatus and a full-color image forming apparatus.

It is desirable for the full-color image forming apparatus of the present invention to comprise:

- a first image carrier;
- a first developing device to develop a first latent image to form a first developing agent image on said first image carrier by using a first developing agent;
- a second image carrier;
- a second developing device to develop a second latent image to form a second developing agent image on said second image carrier;
- a transfer device to transfer the second developing agent image onto a recording surface of a recording material after transfer of the first developing agent image onto the recording surface of the recording material; and
- a fixing device for fixing the transferred developing agent image onto said recording surface, in which the fixing device includes a fixing belt movably supported by a rotatable heating member and a rotatable support member equipped with a surface elastic layer having a hardness not higher than 40°, and a pressurizing mechanism arranged to face the support member with the fixing belt interposed therebetween and equipped with a pressurizing member movable in synchronism with the fixing belt.

In the full-color image forming apparatus of the construction described above, it is possible to form third and fourth developing agent images by using third and fourth developing agents, etc., in accordance with the kinds of the required colors of the developing agents. It is also possible to arrange third and fourth image carriers in accordance with the number of kinds of the developing agents used. Alternatively, it is possible to use only one image carrier without arranging a plurality of image carriers.

According to the present invention, the fixing belt pressed against the developing agent image and the transfer material is pressed in the fixing step against the pressurizing member by the support member including a surface elastic layer having a hardness not higher than 40°. As a result, the fixing belt is pressurized appropriately without being wrinkled so as to fix the developing agent image sufficiently and to prevent the dots from collapsing and, thus, from becoming nonuniform. It follows that it is possible to obtain an image of a high precision free from roughness and nonuniform fixing.

It is desirable to use a developing agent containing a binder resin having a softening point falling within a range of between 105° C. and 130° C., more desirably between 110° C. and 115° C. It is also desirable for the fixing temperature, i.e., the temperature on the surface of the fixing belt, to fall within a range of, for example, between 130° C. and 170° C. The softening point of the binder resin noted above is slightly lower than the fixing temperature of this range. According to the present invention, it is possible to prevent the developing agent from being melted excessively so as to achieve sufficient fixing and to prevent the nonuniformity of the dots by using a binder resin having a softening point of this temperature range and by pressurizing the fixing belt appropriately, thereby obtaining an image of high precision.

The present invention also provides a method for forming an image using the image forming apparatus described above, comprising:

developing a latent image to form a developing agent image on an image carrier by using a developing agent;

transferring the developing agent image onto a recording surface of a recording material to form a transferred image; and fixing the transferred image to the recording surface so as to form a transferred image.

The fixing device described above is used in tihe fixing process. Specifically, the fixing belt is heated by the rotatable heating member, and the recording material having the transferred image formed thereon is introduced between the fixing belt and the pressurizing member so as to press the pressurizing mechanism against the support body via the fixing belt and the recording material, thereby fixing the transferred image to the recording surface.

In the case of forming a full-color image, the method for forming an image provided by the present invention comprises:

developing a first latent image to form a first developing agent image on a first image carrier by using a first developing agent;

developing a second latent image to form a second developing agent image on a second image carrier by using a second developing agent;

transferring the second developing agent image onto a recording surface of a recording material after transfer of the first developing agent image onto the recording surface of the recording material; and fixing the transferred image to the recording surface by introducing a recording material having the transferred image into a fixing device including a fixing belt movably supported by a rotatable heating member and a rotatable support member equipped with a surface elastic layer having a hardness not higher than 40°, and a pressurizing mechanism arranged to face the support member with the fixing belt interposed therebetween and equipped with a pressurizing member movable in synchronism with the fixing belt so as to permit the heating member to heat the fixing belt and so as to press the pressurizing mechanism against the support member via the fixing belt and the recording material.

In the image forming apparatus of the present invention, it is desirable to introduce the recording material having the developing agent image transferred onto the recording surface, with the recording surface positioned to face the fixing belt and with the recorded surface positioned to face the pressurizing member.

The present invention will now be described in more detail with reference to the accompanying drawings.

FIG. 1 schematically shows as an example the construction of an image forming apparatus according to the present invention. As shown in the drawing, a surface potential at the level of, for example, −500 to 800V is imparted uniformly by a charging device 5 to a photoreceptor drum 1 rotatable in the direction denoted by an arrow "a". An electrostatic latent image is formed on the photoreceptor drum 1 by a light exposure device 7. Then, the electrostatic latent image is converted into a visible toner image with a toner that is negatively charged by a developing device 9. The developing agent used in this step contains a coloring agent and a toner containing a binder resin having a softening point of, for example, 115° C. A transfer member is pressed against the photoreceptor drum 1 downstream of the developing device in the rotating direction of the photoreceptor drum 1. Under this condition, a recording material of a paper sheet is introduced into a transfer nip between the transfer member and the photoreceptor drum 1, and the toner image formed on the photoreceptor drum 1 is transferred onto the paper sheet by a bias voltage of, for example, +300V to +5 kV applied from a high voltage power source 23 to the transfer member. The tip of the paper sheet passing through the transfer nip is moved away from the transfer member downstream of the transfer unit in the rotating direction of the photoreceptor drum 1 so as to be transferred by a guide member into a fixing device 60.

The fixing device 60 includes a heating roller 39, a supporting roller 40, a fixing belt 42 supported by these rollers 39 and 40, and a pressurizing roller 41. The paper sheet P is transferred through between the fixing belt 42 and the pressurizing roller 41 under the state that the toner image formed on the paper sheet P is brought into contact with the fixing belt 42 so as to permit the toner image to be fixed to the paper sheet P.

The residual toner is removed by a cleaning device 17 arranged downstream of the transfer nip in the rotating direction of the photoreceptor drum 1 and, then, the photoreceptor drum 1 is discharged by a discharging means 19.

Figure 2:
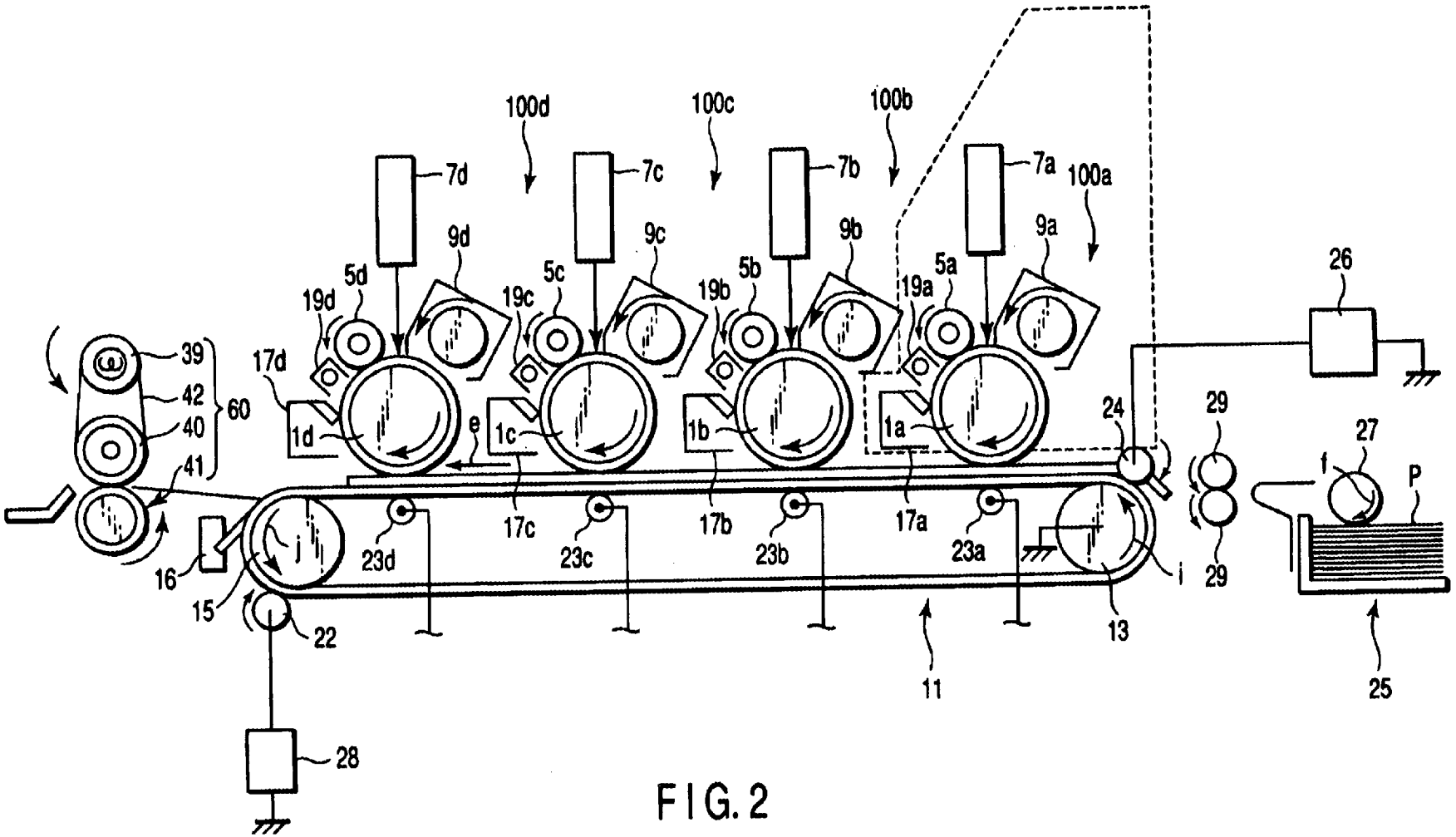
FIG. 2 schematically shows as another example the construction of an image forming apparatus according to the present invention.

FIG. 2 schematically shows as another example the construction of the image forming apparatus of the present invention. As shown in the drawing, the image forming apparatus comprises a photoreceptor drum 1*a* acting as an image carrier. The photoreceptor drum 1*a*, which is a cylindrical lamination type organic photoreceptor having a diameter of 40 mm and a length of 266 mm, is arranged to be rotatable in the direction denoted by an arrow.

Various devices are arranged around the photo-receptor drum 1*a*. Specifically, a charging roller 5*a* formed of a conductive rubber roller and serving to charge uniformly the photoreceptor drum 1*a* is arranged in contact with the surface of the photoreceptor drum 1*a*. A light exposure section 7*a* for exposing the charged photoreceptor drum 1*a* to light so as to form an electrostatic latent image is arranged downstream of the charging roller 5*a* in the rotating direction of the photoreceptor drum 1*a*. A developing device 9*a* housing a first developing agent and serving to develop the electrostatic latent image formed in the light exposure section 7*a* with the first developing agent is arranged downstream of the light exposure section 7*a* in the rotating direction of the photoreceptor drum 1*a*. Further, a transfer means 11 for transferring a paper sheet P used as a recording material toward the photoreceptor drum 1*a* is arranged downstream of the developing device 9*a* in the rotating direction of the photoreceptor drum 1*a*. The transfer means 11 will be described herein later.

Further, a blade cleaning device 17*a* and a discharging lamp 19*a* are arranged downstream of the abutting position of the paper sheet P against the photoreceptor drum 1*a* in the rotating direction of the photoreceptor drum 1*a*. The blade cleaning device 17*a* serves to scratch off the developing agent remaining on the photoreceptor drum 1*a* after transfer of the developing agent image described herein later by utilizing a blade. On the other hand, the discharging lamp 19*a* is formed of, for example, a tungsten lamp serving to discharge the surface of the photoreceptor drum 1*a* after transfer of the developing agent image. One cycle of the image formation is finished by the discharging achieved by the discharging lamp 19*a*. When a next image is formed, the uncharged surface of the photoreceptor drum 1*a* is charged again by the charging roller 5*a*.

The transfer means 11 has a width substantially equal to the drum width of the photoreceptor drum 1*a*. As shown in, for example, FIG. 2, the transfer means 11 is in the form of an endless belt. A tension roller 13 and a driving roller 15 are arranged in the annular regions on the upstream side and the downstream side, respectively, of the transfer means 11. In other words, the endless belt forming the transfer means is stretched between the tension roller 13 and the driving roller 15. Of course, the transfer means 11 is in contact with the outer circumferential surfaces of the tension roller 13 and the driving roller 15 in the annular regions noted above. Incidentally, the distance between the tension roller 13 and the driving roller 15 is set at about 300 mm. The tension roller 13 and the driving roller 15 are arranged to be rotatable in the directions denoted by arrows i and j, respectively, in FIG. 1. In accordance with the rotation of the driving roller 15, the transfer means 11 is circulated in the direction denoted by an arrow e. The transfer speed is controlled to be equal to the rotating speed of the photoreceptor drum 1*a*.

The endless belt used as the transfer means 11 is required to perform two functions, i.e., the functions of transferring the recording material and of transferring the developing agent image, though the endless belt noted above is simply referred to herein as a transfer belt. The transfer belt is formed of a material comprising, for example, 25 parts by weight of conductive carbon particles and 75 parts by weight of a thermosetting polyimide having the conductive carbon particles mixed therein. The material of the transfer belt is put in a mold so as to be formed into a seamless (or endless) belt having a width of 270 mm and a diameter of 80 mm by utilizing an imidizing reaction. The transfer belt thus formed has a thickness of is 100 $\mu$m.

As shown in FIG. 2, a paper feeding cassette 25 housing paper sheets P is arranged in the vicinity of the transfer means 11. A pick-up roller 27 for picking up the paper sheet P one by one is mounted on the paper feeding cassette 25. The pick-up roller 27 is mounted to be rotatable in the direction denoted by an arrow f. A pair of resist rollers 29 consisting of an upper roller and a lower roller are arranged to be rotatable forward of the transfer means 11 in the transfer direction of the paper sheet P picked up by the pick-up roller 27. The pair of resist rollers 29 serve to move the transferred paper sheet P toward the transfer means 11 in accordance with the timing that the tip of the developing agent image formed on the surface of the photoreceptor drum 1*a* is positioned at the tip of the paper sheet P.

The paper sheet P forwarded from the pair of resist rollers 29 is transferred to a suction roller 24 abutting against the transfer means 11 and connected to the ground at the position facing the tension roller 13 with the transfer means 11 interposed therebetween. The suction roller 24 is made of a metal roller made of SUS and having a diameter of, for example, 6 mm. Alternatively, it is also possible to use a conductive rubber roller made of a urethane rubber having carbon particles dispersed therein. Further, it is also possible to use a conductive brush, a corona charger, or the like in place of the suction roller 24.

Voltage is supplied from a power source 26 to the suction roller 24. Voltage of 1.5 kV is applied to the suction roller 24. The amount of the electric charge imparted to the endless belt is increased with increase in the voltage applied to the suction roller 24 so as to increase the sucking force of the suction roller 24. However, in view of the limit in the breakdown voltage of the material of the endless belt, it is desirable for the upper limit of the voltage applied to the suction roller 24 to be about 3 kV.

The suction roller 24 is driven by the endless belt (transfer means) 11 and, thus, is rotated in the direction conforming with the transfer direction of the paper sheet P. A suction bias is applied to the suction roller 24 when the paper sheet P is transferred to the suction roller section. As a result, the front surface of the paper sheet P is charged negative, and the back surface of the paper sheet P on the side of the endless belt 11 (or the tension roller 13) is charged positive. The paper sheet P is sucked onto the suction roller 24 by the electrostatic force produced by this charging.

A first process unit 100*a* is formed of the photoreceptor drum 1*a*, the charging roller 5*a*, the light exposure section 7*a*, the developing device 9*a*, the blade cleaning device 17*a* and the discharging lamp 19*a* described above.

A second process unit 100*b*, a third process unit 100*c* and a fourth process unit 100*d* are arranged together with the first process unit 100*a* on the transfer means 11 between the tension roller 13 and the driving roller 15 in the transfer direction of the paper sheet P. The process unit 100*a*, the process unit 100*b*, the process unit 100*c* and the process unit 100*d* are collectively called herein later a process unit 100. Each of the process unit 100*b*, the process unit 100*c* and the process unit 100*d* is substantially equal in construction to the process unit 100*a*. To be more specific, a photoreceptor drum 1*b*, a photoreceptor drum 1*c* and a photoreceptor drum 1*d* are arranged in substantially the center of each of the process units 100. Also, a charging roller 5*b*, a charging roller 5*c* and a charging roller 5*d* are arranged in the vicinity of the photoreceptor drum 1*b*, the photoreceptor drum 1*c* and the photoreceptor drum 1*d*, respectively.

Further, as in the first process unit 100*a*, a light exposure section 7*b*, a light exposure section 7*c*, a light exposure section 7*d* are arranged downstream of the charging rollers

5*b*, 5*c*, 5*d*, respectively, in the rotating direction of the photosensitive rollers 1*b*, 1*c*, 1*d*. Also, a developing device 9*b*, a developing device 9*c* and a developing device 9*d* are arranged downstream of the light exposure sections 7*b*, 7*c* and 7*d*, respectively. Also, a blade cleaning device 17*b*, a blade cleaning device 17*c* and a blade cleaning device 17*d* are arranged downstream of the developing devices 9*b*, 9*c* and 9*d*, respectively. Further, a discharging lamp 19*b*, a discharging lamp 19*c* and a discharging lamp 19*d* are arranged downstream of the blade cleaning devices 17*b*, 17*c* and 17*c*, respectively.

It should be noted, however, that the developing agents housed in the developing devices 9*a*, 9*b*, 9*c* and 9*d* differ from each other. To be more specific, the first developing agent, i.e., a yellow developing agent, is housed in the developing device 9*a* of the process unit 100*a*. The second developing agent, i.e., a magenta developing agent, is housed in the developing device 9*b* of the process unit 10*b*. The third developing agent, i.e., a cyan developing agent, is housed in the developing device 9*c* of the process unit 100*c*. Further, the fourth developing agent, i.e., a black developing agent, is housed in the developing device 9*d* of the process unit 100*d*.

It is possible for the components of the first to fourth developing agents, particularly, the components other than the coloring material such as the binder resin and the external additives to be equal to or different from each other as far as it is possible to obtain required transfer characteristics. However, it is desirable for the components other than the coloring material to be formed of the same materials because the transfer characteristics can be adjusted easily.

For obtaining a color image, the paper sheet P is transferred by the transfer means 11 so as to be brought into contact successively with each of the photoreceptor drums 1. Transfer means, i.e., a power supply roller 23*a*, a power supply roller 23*b*, a power supply roller 23*c* and a power supply roller 23*d*, are arranged in the abutting positions of the paper sheet P against each of the photoreceptor drums 1. In other words, each of the power supply rollers is positioned to face the photoreceptor drum 1, with the transfer means 11 interposed therebetween, such that the power supply roller is in contact with the back surface of the transfer means.

The image forming process performed by the image forming apparatus of the construction described above will now be described. In the first step, each of the rotating photoreceptor drums 1*a*, 1*b*, 1*c* and 1*d* of the four process units is uniformly charged to about −500V by the contact charging roller to which is applied a DC bias superposed with AC. The photoreceptor drums 1*a*, 1*b*, 1*c* and 1*d* charged uniformly by the charging rollers 5*a*, 5*b*, 5*c*, and 5*d* are irradiated with light beams emitted from the light exposure sections 7*a*, 7*b*, 7*c* and 7*d* each consisting of a solid scanning head for is performing the light exposure by a phosphor so as to form electrostatic latent images on the surfaces of the photoreceptor drums 1*a*, 1*b*, 1*c* and 1*d*, respectively. The electrostatic latent images thus formed are developed with the developing agents of various colors housed in the developing devices 9*a*, 9*b*, 9*c*, 9*d* and charged sufficiently in advance.

On the other hand, the paper sheet P is picked up by the pick-up roller 27 from the paper feeding cassette 25 so as to be forwarded to the paired resist rollers 29. The paired resist rollers 29 take the timing with the rotation of the photoreceptor drum 1 such that the tip of the developing agent image formed on the surface of the photoreceptor drum 1 is positioned at the tip of the paper sheet P and, then, the paper sheet P is forwarded onto the transfer means 11.

When the paper sheet P is transferred to the transfer position of the first transfer station, a bias voltage is applied from the power supply roller 23 to the transfer means 11. By the application of the bias voltage, a transfer electric field is formed between the photoreceptor drum 1 and the transfer means 11. As a result, the first developing agent image formed on the photoreceptor drum 1*a* is transferred onto the paper sheet P, and the paper sheet P bearing the first developing agent image is transferred to reach the photoreceptor drum 1*b*. Then, the second developing agent image formed on the surface of the photoreceptor drum 1*b* is transferred onto the paper sheet P such that the second developing agent image is superposed on the first developing agent image transferred previously onto the paper sheet P. The paper sheet P is further transferred such that the third and fourth developing agent images formed on the surfaces of the photo-receptor drums 1*c* and 1*d* are transferred onto the paper sheet P such that the third and fourth developing agent images are superposed on the first and second developing agent images formed previously on the paper sheet P.

The paper sheet P bearing the first to fourth developing agent images superposed one upon the other is transferred from the transfer means 11 into the fixing device 60 of the construction equal to that shown in FIG. 1. On the other hand, the surface of the transfer means (endless belt) 11 is cleaned by a blade cleaning device 16 arranged in the vicinity of the driving roller 15 downstream of the release position of the paper sheet P from the transfer means 11 in the rotating direction of the driving roller 15.

FIG. 2 also shows a suction roller 22 abutting against the transfer means 11 at a position facing the driving roller 15, with the transfer means 11 interposed therebetween. Voltage is supplied from a power source 28 to the suction roller 22.

The image forming apparatus of the particular construction permits the developing agent of any color to be transferred satisfactorily so as to form a color in image excellent in color reproducibility.

Figure 3:
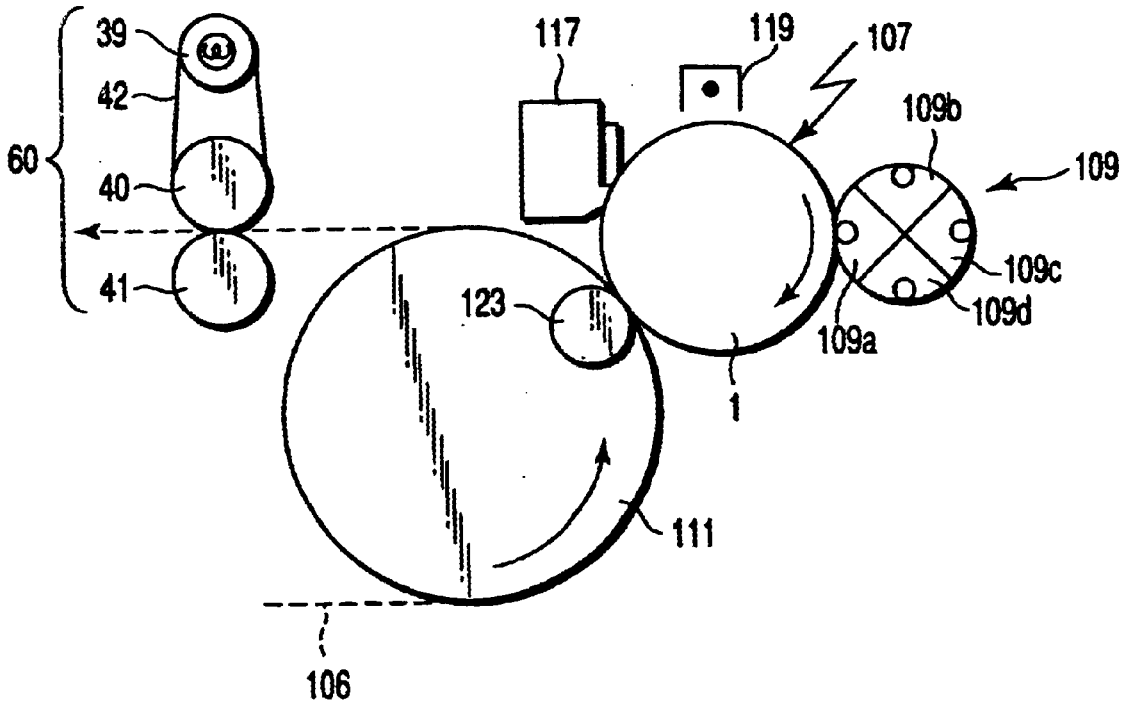
FIG. 3 schematically shows as the other example the construction of an image forming apparatus according to the present invention.

FIG. 3 schematically shows as another example the construction of the image forming apparatus of the present invention.

As shown in the drawing, the image forming apparatus comprises a photoreceptor drum 101 acting as an image carrier. The photoreceptor drum 101 is a cylindrical lamination type organic photoreceptor having, for example, a diameter of 40 mm and a length of 266 mm, and is arranged to be rotatable in the direction denoted by an arrow in FIG. 3.

Various devices are arranged around the photoreceptor drum 111 in the rotating direction of the photoreceptor drum 111.

Specifically, a developing device 109 housing various colors of developing agents and serving to develop the electrostatic latent image formed on the surface of the photoreceptor drum 101 in the light exposure section 107 is arranged to face the photoreceptor drum 101. A transfer means 111 in the form of, for example, a roller, which serves to transfer a recording material of a paper sheet to the photoreceptor drum 101, is arranged downstream of the developing device 109 in the rotating direction of the photoreceptor drum 101. The transfer means 111 is rotatable in synchronism with the rotation of the photoreceptor drum 101 so as to permit the developing agent image formed on the surface of the photoreceptor drum 101 by the developing device 109 to be transferred onto the recording material. Further, a blade cleaning device 117 and a discharging lamp 119 are arranged downstream of the transfer means 111 in the rotating direction of the photoreceptor drum 101. The blade cleaning device 117 serves to scratch off with the blade the developing agent remaining on surface of the photoreceptor drum 101 after transfer of the developing agent image. On the other hand, the discharging lamp 119 is formed of, for example, a tungsten lamp serving to discharge the surface of the photoreceptor drum after removal of the residual developing agent. One cycle of the image formation is finished by the discharging operation performed by the discharging lamp 119. When the next image is formed, the uncharged photoreceptor drum 101 is charged again.

A paper feeding cassette (not shown) housing paper sheets is arranged in the vicinity of the transfer means 111. A paper sheet is transferred from the paper feeding cassette in the direction denoted by an arrow 106 into the clearance between the photoreceptor drum 101 and the transfer means 111.

As shown in FIG. 3, the developing device 109 is partitioned into four sections so as to form a first developing section 109*a*, a second developing section 109*b*, a third developing section 109*c* and a fourth developing section 109*d*. The developing device 109 is arranged to be rotatable such that the first developing section 109*a*, the second developing section 109*b*, the third developing section 109*c* and the fourth developing section 109*d* are moved to face successively the photoreceptor drum 101. As in the image forming apparatus shown in FIG. 2, a first developing agent, a second developing agent, a third developing agent and a fourth developing agent are housed in the first developing section 109*a*, the second developing section 109*b*, the third developing section 109*c* and the fourth developing section 109*d*, respectively.

The image formation is performed as follows in the image forming apparatus constructed as described above.

In the first step, a bias voltage is applied to the photoreceptor drum 101 by a charging means (not shown) so as to uniformly charge the surface of the photoreceptor drum 101. Then, a first electrostatic latent image is formed on the surface of the photoreceptor drum 101 by means of light irradiation 107. Further, the developing device 109 and the photoreceptor drum 101 are rotated to permit the developing section 109*a* to face the electrostatic latent image formed on the surface of the photoreceptor drum 101. Under this condition, the first developing agent is supplied from the developing section 109*a* onto the electrostatic latent image so as to form a first developing agent image.

When a paper sheet is transferred to the transfer position of the developing agent image, a bias voltage is applied from a power supply means 123 to the transfer device 111. By the application of the bias voltage, a transfer electric field is formed between the photoreceptor drum 101 and the transfer means 111. As a result, the first developing agent image formed on the surface of the photoreceptor drum 101 is transferred onto the paper sheet.

After transfer of the first developing agent image onto the paper sheet, the residual first developing agent and the charge on the surface of the photoreceptor drum 101 are removed by the cleaning device 117 and the discharging means 119.

In the next step, a second electrostatic latent image is formed by means of the light irradiation 107 on the surface of the photoreceptor drum 101 where the residual first developing agent and charge are removed therefrom. Then, the photoreceptor drum 101 is rotated by ¼ of one complete rotation so as to permit the developing section 109*b* to face the second electrostatic latent image formed on the surface of the photoreceptor drum 101.

Under this condition, the second developing agent is supplied onto the second electrostatic latent image so as to form a second developing agent image. Then, a bias voltage is applied again from the power supply means 123 to the transfer means 111. By this bias voltage application, a transfer electric field is formed between the photoreceptor drum 101 and the transfer means 111. As a result, the second developing agent image formed on the surface of the photoreceptor drum 101 is transferred onto the paper sheet having the first developing agent image transferred thereto in advance.

The process described above is repeated in respect of each of the third developing agent and the fourth developing agent so as to form multilayers in which the first to fourth developing agent images are superposed one upon the other.

The paper sheet bearing the color image formed by the transfer of the multiple developing agent images is transferred in the direction denoted by the arrow 106 so as to be introduced into the fixing device 60 having the construction equal to that shown in FIG. 2. In the fixing device 60, the paper sheet is passed through the clearance between the fixing belt 42 and the pressurizing roller 41 such that the developing agent image formed on the paper sheet is brought into contact with the fixing belt 42 so as to fix the developing agent image to the paper sheet.

Figure 4:
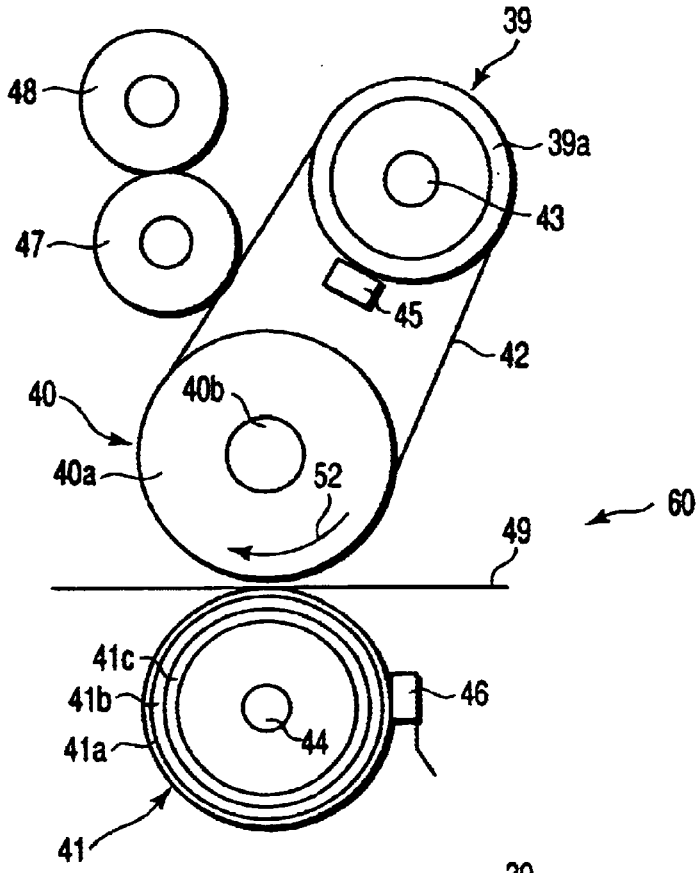
FIG. 4 schematically shows as an example the construction of a fixing device according to the present invention.
Figure 5:
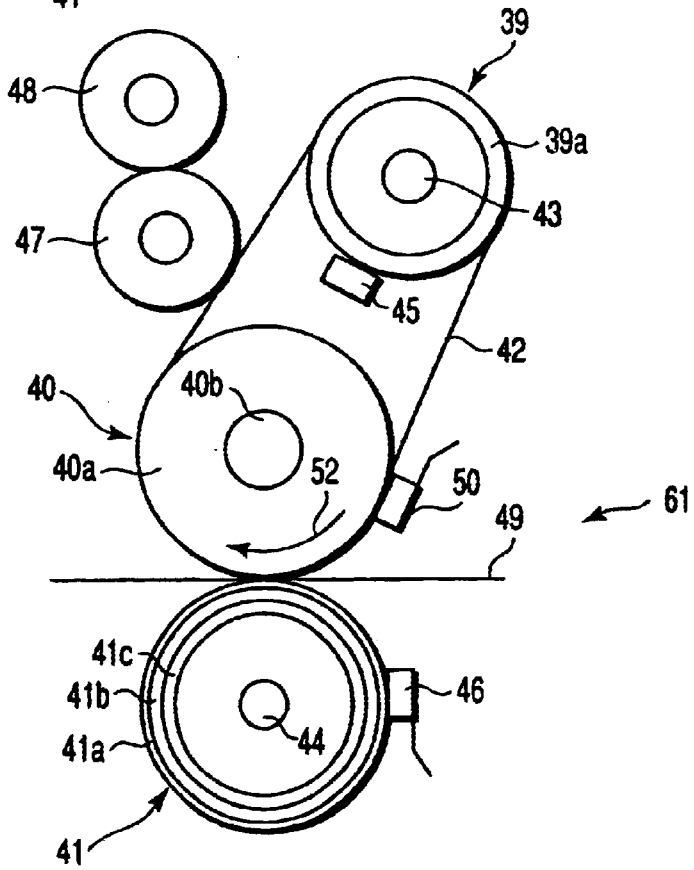
FIG. 5 schematically shows as another example the construction of a fixing device according to the present invention.

FIG. 4 schematically shows as an example the construction of the fixing device used in the image forming apparatus of the present invention. Also, FIG. 5 shows a modification of the fixing device shown in FIG. 4.

As shown in the drawings, the fixing device comprises a heating roller 39, a supporting roller 40, a fixing belt 42 supported by the heating roller 39 and the supporting roller 40, and a pressurizing roller 41 arranged to face the supporting roller 40 with the fixing belt 42 interposed therebetween.

The fixing belt 42 includes a thin seamless belt (an endless belt) having a thickness of, for example, 37 $\mu$m and formed of a thin metal plate such as a nickel plate, the endless belt being used as a base material, a silicone rubber layer formed on the surface of the base material and having a thickness of 200 $\mu$m, and a PFA tube 41*a* formed on the surface of the silicone rubber layer and having a thickness of 30 $\mu$m. The heating roller 39 is arranged inside the fixing belt 42 and serves to heat the fixing belt 42 and to impart tension to the fixing belt 42. Further, the supporting roller 40, which also serves to impart tension to the fixing belt 42 and to drive the fixing belt 42, is pressed against the pressurizing roller 41 with the fixing belt 42 interposed therebetween.

The heating roller 39 includes an aluminum pipe used as a core and having a diameter of, for example, 30 mm and a thickness of 3 mm, and a covering layer 39*a* having a thickness of about 20 $\mu$m, formed of polytetrafluoroethylene (PTFE), and covering the outer surface of the core. Also, a heater lamp 43 of 550 W is arranged as a heating source inside the heating roller 39.

The supporting roller 40 includes a core 40*b* formed of a stainless steel pipe having a diameter of, for example, 22 mm and a heat-resistant elastic body 40*a* covering the outer circumferential surface of the core 40*b* and having an outer diameter of, for example, 38 mm. The heat-resistant elastic body 40*a* is formed of a silicone sponge having an ASKER-C hardness of 30° and a thickness of 8 mm. It is desirable for the heat resistant elastic body 40*a* to be formed of sponge because sponge exhibits high thermal insulating properties and is capable of ensuring a nip with a low load. It is also possible to use rubber for forming the heat-resistant elastic body 40*a*.

The pressurizing roller 41 is arranged to face the supporting roller 40, and applies a load of about 250N by using a spring (not shown) to the supporting roller 40 via the fixing belt 42 so as to form a nip width of 7.5 mm. The pressurizing roller 41 includes a core 41*c* formed of an aluminum pipe having an outer diameter of, for example, 40 mm, an ASKER-C hardness of 80°, and a thickness of 5 mm, and a silicone rubber layer 41*b* formed on the outer circumferential surface of the core 41*c* and having a thickness of 1 mm and JIS-A hardness of 20°. Further, the outer circumferential surface of the silicone rubber layer 41*b* is covered with a PFA tube having a thickness of 30 μm. It should also be noted that a heating lamp 44 of 450 W is arranged as a heating source inside the pressurizing roller 41.

An oil coating roller 47 serving to prevent the offset of the toner to the fixing belt 42 is arranged in contact with the outer surface of the fixing belt 42. Further, a cleaning roller 48 serving to remove the toner, paper dust, etc., attached to the oil coating roller 47 is arranged in contact with the outer surface of the oil coating roller 47. The oil coating roller 47 has an outer diameter of 22 mm and includes a core and a heat-resistant paper sheet wound about the core and impregnated with an oil. Further, the outer circumferential surface of the heat-resistant paper sheet is covered with a porous tube of a fluorine-containing resin serving to control the oil coating and having high release characteristics. The particular construction permits traces of the oil coating on the fixing belt 42. Further, the cleaning roller 48 includes an aluminum roller having an outer diameter of 21 mm and a fluorine-containing resin layer coated on the outer surface of the aluminum roller and having a thickness of 20 μm.

A thermistor 45 is arranged on the outer surface of the heating roller 39 in order to control the heating lamp 43 arranged inside the heating roller 39. To be more specific, the thermistor 45 serves to detect the temperature on the outer surface of the heating roller 39. It is possible to arrange the thermistor 45 on the surface of the fixing belt 42 wound about the outer circumferential surface of the heater roller 39. In order to control the heating lamp 44 arranged inside the pressurizing roller 41, the thermistor 46 is arranged on the surface of the pressurizing roller 41 so as to detect the temperature on the surface of the pressurizing roller 41. The fixing device 61 shown in FIG. 5 is equal to that shown in FIG. 4, except that a thermistor 50 is arranged in a region other than the region where the fixing belt 42 is wound about the heating roller 39 so as to detect the temperature on the surface of the fixing belt 42.

The operation of the fixing device 60 will now be described briefly.

In the fixing device 60, the supporting roller 40 is rotated in the direction denoted by an arrow 52 by the driving of a motor (not shown). In accordance with rotation of the supporting roller 40, the fixing belt 42, the heating roller 39, and the pressurizing roller 41 are also rotated. The fixing belt 42 is heated in the contact region with the heating region 39, and the heated region is moved to reach the nip portion between the supporting roller 40 and the pressurizing roller 41 in accordance with rotation of the fixing belt 42. When a recording paper sheet 49 passes through the nip portion, the unfixed toner image (not shown) formed on the recording paper sheet 49 is brought into contact with the fixing belt 42 so as to be fixed to the recording paper sheet 49 under the heat and pressure so as to form a fixed image.

The present invention will now be describe in detail with reference to an Examples of the present invention.

EXAMPLES

Toner materials of four colors were prepared as follows:

| | |
|---|---|
| Yellow Toner Composition: | |
| Polyester resin ($T_m$ = 110° C.) | 92 parts by weight |
| Yellow pigment (Pig.Y.180) | 4 parts by weight |
| Rice wax | 3 parts by weight |
| Zinc complex | 1 part by weight |
| Magenta Toner Composition: | |
| Polyester resin ($T_m$ = 110° C.) | 90 parts by weight |
| Magenta pigment (Pig.R.122) | 6 parts by weight |
| Rice wax | 3 parts by weight |
| Zinc complex | 1 part by weight |
| Cyan Toner Composition: | |
| Polyester resin ($T_m$ = 110° C.) | 92 parts by weight |
| Cyan pigment (Pig.B.15-3) | 4 parts by weight |
| Rice wax | 3 parts by weight |
| Zinc complex | 1 part by weight |
| Black Toner Composition: | |
| Polyester resin ($T_m$ = 110° C.) | 92 parts by weight |
| Black pigment (Carbon black) | 4 parts by weight |
| Rice wax | 3 parts by weight |
| Zinc complex | 1 part by weight |

The toner materials were kneaded in a biaxial continuous kneading machine, followed by pulverizing the kneaded material and classifying the pulverized material by using a collision type pulverizing machine and an air stream type classifying machine so as to obtain a colored toner mother material having a particle diameter of 8 μm. Further, 1.0% of silica (R972 manufactured by Nippon Aerosil K.K.) was mixed with the toner mother material of each color by using a Henschel mixer manufactured by Mitsui Kozan K.K. so as to obtain yellow, magenta, cyan and black toners.

Incidentally, the softening point of the toner binder was measured by using a flow tester manufactured by Shimazu Seisakusho K.K.

Figure 6:
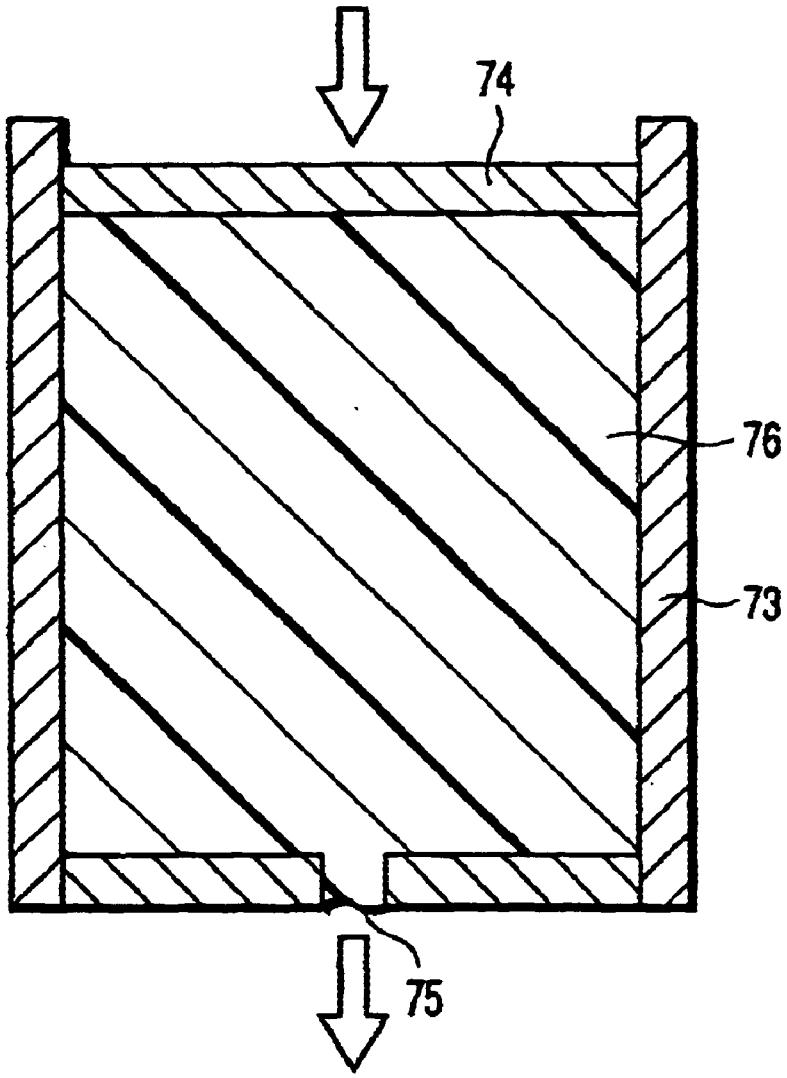
FIG. 6 schematically shows the construction of a flow tester.

FIG. 6 schematically shows the construction of the flow tester.

As shown in the drawing, the flow tester comprises a cylinder 73 having a die 75 at one end and a plunger 74 at the other end. In this flow tester, 1*g* of a sample 76 is put in the cylinder 73 and pressurized with a load of 20 kg by the plunger 74 while heating the sample 76 and the cylinder 73 at a rate of 6° C./min. When a predetermined temperature is reached, the sample is melted so as to begin to flow out of the die 75. In accordance with the temperature elevation, all the sample flows out of the cylinder 73 and the downward movement of the plunger 74 is stopped. The temperature when the plunger 74 moves downward to reach the position where half amount of the sample flows out is determined as ½ drop temperature.

| | |
|---|---|
| RATE TEMP | 6,000° C./min |
| SET TEMP | 70.00° C. |
| MAX TEMP | 150.0° C. |
| INTERVAL | 3,000° C. |
| PREHEAT | 300.0 sec |
| POS. MIN | 1.000 mm |
| POS. MAX | 15.00 mm |

-continued

| | |
|---|---|
| LOAD | 20.00 kg |
| DIE (DIA) | 1.000 mm |
| DIE (LENG) | 1.000 mm |
| K.FACTOR | 1.000 |
| PLUNGER | 1.000 $cm^{-2}$ |

The point on the flow curve corresponding to ½ of the dropping amount of the plunger was set as the measured value based on the flowchart.

Each of the toners thus obtained was used in "Fantasia 22", a full-color copying machine manufactured by Toshiba Tec K.K., equipped with a fixing mechanism of the construction equal to that shown in FIG. 5 so as to obtain a photographic image of a human being and scenery. The roughness and the transparency of the image were examined. For evaluating the roughness, a photographic image of a human being and scenery was produced so as to visually determine the roughness. Also, for evaluating the transparency, an OHP image was produced by the copying machine noted above and the projected image was visually observed for determining the transparency. Table 1 shows the results.

TABLE 1

| | Softening point Tm of binder resin | | | | | | | | | |
|---|---|---|---|---|---|---|---|---|---|---|
| | 95 | 100 | 105 | 110 | 115 | 120 | 125 | 130 | 135 | 140 |
| Roughness | | | | | | | | | | |
| Hardness of fixing roller | | | | | | | | | | |
| 20 | X | X | ○ | ◎ | ◎ | ◎ | ◎ | ◎ | ◎ | ◎ |
| 25 | X | X | ○ | ◎ | ◎ | ◎ | ◎ | ◎ | ◎ | ◎ |
| 30 | X | X | X | ◎ | ◎ | ◎ | ◎ | ◎ | ◎ | ◎ |
| 35 | X | X | X | ◎ | ◎ | ◎ | ◎ | ◎ | ◎ | ◎ |
| 40 | X | X | X | X | X | ◎ | ◎ | ◎ | ◎ | ◎ |
| 45 | X | X | X | X | X | X | X | X | ◎ | ◎ |
| Transparency | ◎ | ◎ | ◎ | ◎ | ◎ | ○ | ○ | ○ | X | X |

As apparent from Table 1, in the present invention, in which are used a fixing belt and a supporting roller including a surface elastic layer having a hardness not higher than 40°, it is possible to prevent excessive melting of the toner and to avoid nonuniform melting so as to obtain a full-color image of high quality free from the roughness. Particularly, it has been found that it is desirable to use a binder resin having a softening point Tm falling within a range of between 105° C. and 130° C. It has been found that, if the softening point Tm exceeds 135° C., the transparency is rendered markedly poor because of insufficient melting of the toner so as to render poorly the OHP transparency.

Further, it has been found that, if the hardness of the fixing roller is not higher than 35° and if the softening point Tm of the toner binder falls within a range of between 110° C. and 115° C., it is possible to suppress the roughness and to improve the transparency so as to obtain an excellent image.

Incidentally, the fixing belt used in the experiment was covered with a PFA resin and, thus, exhibits high abrasion properties. Also, it has been confirmed that a defect such as wrinkling of the PFA resin does not take place in the manufacturing process in the fixing belt of this Example.

As described above, the present invention makes it possible to prevent wrinkling in the fixing step so as to easily obtain a high quality image at a low cost.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus, comprising:

an image carrier;

a developing device to form a developing agent image on said image carrier by using a developing agent containing a binder resin having a softening point falling within a range of between 105° C. and 130° C.;

a transfer device to transfer said developing agent image onto a recording surface of a recording material; and a fixing device to fix the transferred developing agent image onto said recording surface, said fixing device including:

a rotatable heating member, a rotatable support member having a metal core and a silicone sponge layer having a hardness not higher than 40° and formed on the surface of said metal core, a fixing belt movably supported by said rotatable heating member and said rotatable support member, having a thickness of 150 to 400 $\mu$m and having a thin metal plate, a silicone rubber layer formed on the surface of said thin metal plate, and a perfluoroalkoxy resin layer formed on said silicone rubber layer, and a pressurizing mechanism arranged to face said rotatable support member with said fixing belt interposed therebetween and equipped with a pressurizing member movable in synchronism with said fixing belt, said pressurizing member having a metal core, a silicone rubber layer formed on the surface of said metal core, and a perfluoroalkoxy resin layer formed on said silicone rubber layer.

2. An image forming apparatus according to claim 1, wherein said developing agent contains a binder resin having a softening point falling within a range of between 105° C. and 130° C.

3. An image forming apparatus according to claim 2, wherein said binder resin has a softening point falling within a range of between 110° C. and 115° C.

4. An image forming apparatus according to claim 1, wherein said silicone sponge layer has a hardness falling within a range of between 10° and 40°.

5. An image forming apparatus according to claim 4, wherein said silicone sponge layer has a hardness falling within a range of between 20° and 35°.

6. An image forming apparatus, comprising:

a first image carrier;

a first developing device to form a first developing agent image on said first image carrier by using a first developing agent containing a binder resin having a softening point falling within a range of between 105° C. and 130° C.;

a second image carrier;

a second developing device to form a second developing agent image on said second image carrier by using a second developing agent containing a binder resin having a softening point falling within a range of between 105° C. and 130° C.;

a transfer device to transfer said second developing agent image onto a recording surface of a recording material after transfer of said first developing agent image onto said recording surface of said recording material; and a fixing device to fix the transferred developing agent image onto said recording surface, said fixing device including:

a rotatable heating member, a rotatable support member having a metal core and a silicone sponge layer having a hardness not higher than 40° and formed on the surface of said metal core, a fixing belt movably supported by said rotatable heating member and said rotatable support member, having a thickness of 150 to 400 μm and having a thin metal plate, a silicone rubber layer formed on the surface of said thin metal plate, and a perfluoroalkoxy resin layer formed on said silicone rubber layer, and a pressurizing mechanism arranged to face said rotatable support member with said fixing belt interposed therebetween and equipped with a pressurizing member movable in synchronism with said fixing belt, said pressurizing member having a metal core, a silicone rubber layer formed on the surface of said metal core, and a perfluoroalkoxy resin layer form ed on said silicone rubber layer.

7. An image forming apparatus according to claim 6, where said first and second image carriers are identical.

8. An image forming apparatus according to claim 7, wherein said binder resin of said first and second developing agents have a softening point falling within a range of between 110° C. and 115° C.

9. An image forming apparatus according to claim 6, wherein said first and second developing agents contain a binder resin having a softening point falling within a range of between 105° C. and 130° C.

10. An image forming apparatus according to claim 6, wherein said silicone sponge has a hardness falling within a range of between 10° and 40°.

11. An image forming apparatus according to claim 6, wherein said silicone sponge layer has a hardness failing within a range of between 20° and 35°.

12. A method for forming an image, comprising:

forming a developing agent image on an image carrier by using a developing agent containing a binder resin having a softening point falling within a range of between 105° C. and 130° C.;

transferring said developing agent image onto a recording surface of a recording material to form a transferred image; and fixing said transferred image to said recording surface by introducing a recording material having said transferred image into a fixing device including:

a rotatable heating member, a rotatable support member having a metal core and a silicone sponge layer having a hardness not higher than 40° and formed on the surface of said metal core, a fixing belt movably supported by said rotatable heating member and said rotatable support member, having a thickness of 150 to 400 μm and having a thin metal plate, a silicone rubber layer formed on the surface of said thin metal plate, and perfluoroalkoxy resin layer formed on said silicone rubber layer, and a pressurizing mechanism arranged to face said rotatable support member with said fixing belt interposed therebetween and equipped with a pressurizing member movable in synchronism with said fixing belt, said pressurizing member having a metal core, a silicone rubber layer formed on the surface of said metal core, and a perfluoroalkoxy resin layer formed on said silicone rubber layer.

13. A method for forming an image, comprising:

forming a first developing agent image on a first image carrier by using a first developing agent containing a binder resin having a softening point falling within a range of between 105° C. and 130° C.;

forming a second developing agent image on a second image carrier by using a second developing agent containing a binder resin having a softening point falling within a range of between 105° C. and 130° C.;

transferring said second developing agent image onto a recording surface of a recording material after transfer of said first developing agent image onto said recording surface of said recording material; and fixing said transferred image to said recording surface by introducing a recording material having said transferred image into a fixing device including:

a rotatable heating member, a rotatable support member having a metal core and a silicone sponge layer having a hardness not higher than 40° and formed on the surface of said metal core, a fixing belt movably supported by said rotatable heating member and said rotatable support member, having a thickness of 150 to 400 μm and having a thin metal plate, a silicone rubber layer formed on the surface of said thin metal plate, and a perfluoroalkoxy resin layer formed on said silicone rubber layer, and a pressurizing mechanism arranged to face said rotatable support member with said fixing belt interposed therebetween and equipped with a pressurizing member movable in synchronism with said fixing belt, said pressurizing member having a metal core, a silicone rubber layer formed on the surface of said metal core, and a perfluoroalkoxy resin layer formed on said silicone rubber layer.

14. A fixing device, comprising:

a rotatable heating member, a rotatable support member having a metal core and a silicone sponge layer having a hardness not higher than 40° and formed on the surface of said metal core, a fixing belt movably supported by said rotatable heating member and said rotatable support member, having a thickness of 150 to 400 $\mu$m and having a thin metal plate, a silicone rubber layer formed on the surface of said thin metal plate, and a perfluoroalkoxy resin layer formed on said silicone rubber layer, and a pressurizing mechanism arranged to face said rotatable support member with said fixing belt interposed therebetween and equipped with a pressurizing member movable in synchronism with said fixing belt, said pressurizing member having a metal core, a silicone rubber layer formed on the surface of said metal core, and a perfluoroalkoxy resin layer formed on said silicone rubber layer.

15. A fixing device according to claim 14, wherein said hardness falls within a range of between 10° and 40°.

16. A fixing device according to claim 15, wherein said hardness falls within a range of between 20° and 35°.

* * * * *